US005145557A

United States Patent [19]

Peter et al.

[11] Patent Number: 5,145,557

[45] Date of Patent: Sep. 8, 1992

[54] CHLORINE-FREE BLEACHING METHOD FOR DISSOLVING-GRADE PULPS USING AN OP-Z-P SEQUENCE

[75] Inventors: Walter Peter, Vocklabruck; Anton Hruschka, Vienna; Oskar Höglinger, Timelkam, all of Austria

[73] Assignee: Lenzing Aktiengesellschaft, Lenzing, Austria

[21] Appl. No.: 652,027

[22] Filed: Feb. 7, 1991

[30] Foreign Application Priority Data

Feb. 7, 1990 [AT] Austria ..... 261/90

[51] Int. Cl.[5] ..... D21C 9/153; D21C 9/16

[52] U.S. Cl. ..... 162/40; 162/65; 162/78

[58] Field of Search ..... 162/40, 65, 78, 19

[56] References Cited

U.S. PATENT DOCUMENTS 4,196,043 4/1980 Singh ..... 162/65
4,283,251 8/1981 Singh ..... 162/65
4,619,733 10/1986 Kooi ..... 162/65

OTHER PUBLICATIONS

Rydholm, "Pulping Processes", Interscience Publishers, New York, 1967, pp. 1049–1051.

*Primary Examiner*—Steve Alvo
*Attorney, Agent, or Firm*—Herbert Dubno; Jonathan Myers

[57] ABSTRACT

A three-stage bleaching process for dissolving grade pulp utilizes the sequence OP(alkaline)-Z-P and the off gas from the Z-stage is delivered to the alkaline (OP)-stage whose parameters are controlled to fully react all of the oxygen of the off gas. The filtrate or waste water from the Z-stage, at a pH below 3, serves to dilute the alkaline OP-stage pulp before Z-stage bleaching and/or for de-ashing of the P pulp following the P-stage.

9 Claims, 1 Drawing Sheet

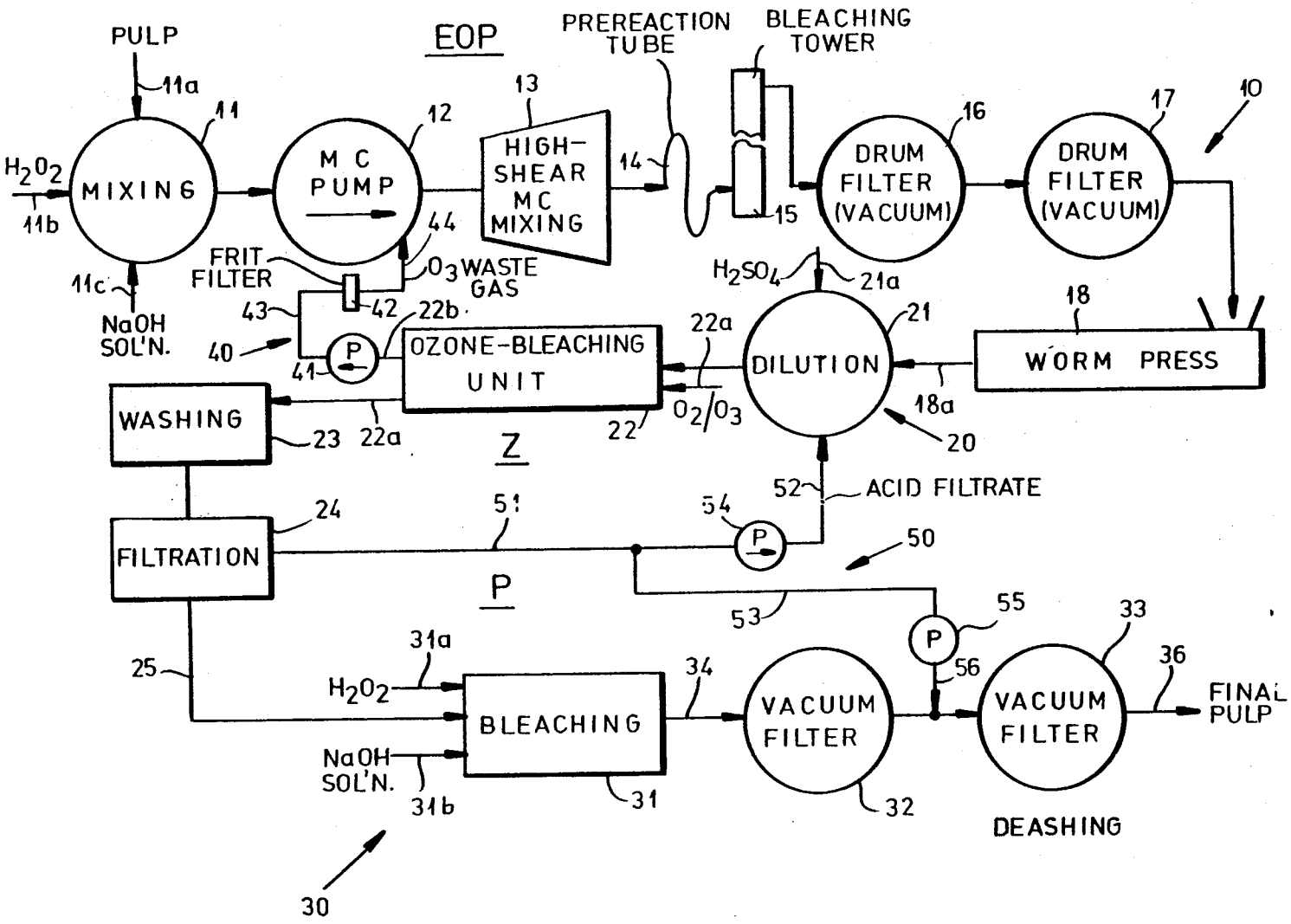
EOP
PULP
MIXING
$H_2O_2$
NaOH SOL'N.
MC PUMP
HIGH-SHEAR MC MIXING
PREREACTION TUBE
BLEACHING TOWER
DRUM FILTER (VACUUM)
DRUM FILTER (VACUUM)
WORM PRESS
DILUTION
$H_2SO_4$
ACID FILTRATE
OZONE-BLEACHING UNIT
$O_2/O_3$
WASTE GAS
$O_3$
FRIT FILTER
WASHING
FILTRATION
Z
P
VACUUM FILTER
VACUUM FILTER
DEASHING
BLEACHING
$H_2O_2$
NaOH SOL'N.
FINAL PULP

CHLORINE-FREE BLEACHING METHOD FOR DISSOLVING-GRADE PULPS USING AN OP-Z-P SEQUENCE

CROSS REFERENCE TO RELATED APPLICATION

This application is related to the commonly owned copending application Ser. No. 07/605,744 filed Oct. 30, 1990 and based, in turn, upon Austrian national applications A2494/89 of Oct. 30, 1989 and A2588/89 filed Nov. 10, 1989.

FIELD OF THE INVENTION

Our present invention relates to a process for the chlorine-free bleaching of dissolving-grade pulps with ozone in a three-stage procedure and, more particularly, to a chlorine-free bleaching of such pulps using an initial oxygen bleaching optionally involving a hydrogen peroxide bleaching, an alkaline (OP-stage), also referred to as an EOP-stage; an ozone bleaching (Z stage) and a peroxide bleaching (P stage).

BACKGROUND OF THE INVENTION

Since chlorine is a poisonous gas which is difficult to control and chlorine-containing bleaching agents give rise to waste waters containing environmentally hazardous chlorine compounds and the discharge of such waste waters is banned in many places at the present time and in the future will simply not be tolerable, for the bleaching of pulps a variety of processes have been developed which utilize $O_2$, $H_2O_2$ or $O_3$ in various combinations under a variety of operating conditions as environmentally sound alternatives.

A process of the aforedescribed type is found in U.S. Pat. No. 4,216,054, see Example 24 (which relates back to Examples 10, 2 and 1). In this system, Douglas fir pulp is bleached with relatively poor results (brightness 74.6 Elrephro).

Canadian patent 1,103,409 describes a bleaching process in which three ozone stages in series are used and the ozone-containing residual gas from the third ozone bleaching stage is fed to the first ozone bleaching stage to utilize the residual ozone content. The residual gas from the first ozone bleaching stage, however, is not further utilized and must be processed before discharge.

OBJECTS OF THE INVENTION

It is the principal object of our present invention to provide a method of bleaching dissolving pulps which avoids the problem of environmental contamination and yet provides an improvement over the environmentally-sound techniques previously described, both in terms of lower cost, environmental considerations and energy conservation.

Another object of this invention is to provide a low-cost, energy-conserving and effective bleaching process, free from the use of chlorine which can obtain greater brightness of the bleached product than earlier systems.

It is also an object of the present invention to provide a bleaching process or method which avoids the drawbacks of prior art systems.

SUMMARY OF THE INVENTION

These objects are attained, in accordance with the invention, by reacting the residual oxygen content of the off gas of the Z stage in the EOP stage and by utilizing the waste water from the Z stage whose pH value preferably is less than 3, to dilute pulp between the EOP stage and the Z stage and/or for the de-ashing of the pulp after the final bleaching or P stage.

More particularly, the chlorine-free bleaching method of the invention comprises the steps of:

(a) in an alkaline OP-stage, subjecting dissolving-grade pulp to oxygen bleaching optionally in the presence of hydrogen peroxide, and filtering EOP-bleached pulp from a filtrate;

(b) in a Z stage, subjecting the EOP-bleached pulp to ozone bleaching and recovering a Z-stage bleached pulp, an off gas containing residual oxygen and a waste water having a pH of less than 3;

(c) subjecting the Z-stage bleached pulp to peroxide bleaching in a P stage and recovering a final bleached pulp therefrom;

(d) feeding the off gas from the Z stage of step (b) to the EOP stage of step (a) and fully reacting the residual oxygen therein; and (e) selectively feeding the waste water recovered from the Z stage in step (b) as a diluent to the EOP-bleached pulp prior to step (b) and to peroxide-bleached pulp following P-stage bleaching in step (c) for de-ashing of the peroxide-bleached pulp.

It has been found, most surprisingly, that in a bleaching process of this type, it is possible to so select the operating parameters that the residual oxygen content of the off gas from the Z stage can be completely reacted. The result is a chemical feedback which achieves the objects set out above.

With respect to the choice of operating parameters, the following should be noted: In the EOP stage, the kappa values of the pulp must be lowered sufficiently that only a single ozone stage is required after the EOP stage. The significance of the kappa value is discussed in U.S. Pat. No. 4,229,251 and reference to the earlier application with respect to the kappa value is also advantageous. For each ozone treatment stage required in a multi-ozone treatment process, it is recognized that the quality of the pulp is reduced. Hence, by limiting the stages subsequent to the EOP stage to a single ozone treatment stage, a high degree of brightness can be achieved with a significant change in kappa value and with a minimum deterioration of the pulp.

The ozone requirement in the ozone or Z stage can be so controlled by adjustment of the temperature in the EOP stage that the total quantity of the off gas from the Z stage can be fed to the EOP stage and its residual oxygen content, reacted therein. Because of the low ozone charge, the temperature in the Z stage can be selected to be relatively high so that energy costs for cooling and reheating of the pulp between the stages can be minimized. The activation by the temperature and the NaOH quantity in the EOP stage are so selected that the total quantity of the residual gas from the $O_3$ stage is reacted therein.

The EOP stage and the Z stage, from the point of view of chemical balance, can be treated as a unit. The Z stage can be an LC (low consistency) stage, i.e. a stage operated with less than 4 mass % ATS or dry solids, or with an MC (medium consistency) stage, i.e. in a range of 5 to 20 mass % ATS, preferably 7 to 15% ATS as described in the aforementioned copending application.

The second approach is naturally of special advantage when the EOP stage and the P stage are also formed as MC stages. This eliminates the need to dilute the pulp prior to the Z stage and the need for a dewatering of the pulp prior to the P stage or allows either the dilution or the dewatering to be carried out to a very limited degree.

There are various operating parameters which can ensure that the oxygen requirement of the EOP will be satisfied by the residual oxygen content of the off gas from the Z stage. Thus according to the invention, the temperature of the NaOH charge and $O_2/H_2O_2$ ratio in the EOP stage are so controlled that the oxygen consumption at constant throughput of the EOP stage corresponds to the residual oxygen content of the off gas from the Z stage.

Advantageously, the temperature in the EOP stage is maintained between 70° and 100° C., preferably 75° C., the NaOH concentration in the EOP stage is between 2.5 and 5 mass % based upon the bleached dry pulp, and the concentration of $O_2$ in the $O_2$–$H_2O_2$ mixture in the EOP stage is 50 to 100 mass % and the concentration of the $H_2O_2$ therein is 0–50 mass %. It will be understood that generally neither 100% $O_2$ nor 0% $H_2O_2$ will be used but that these limits can be momentarily reached, the mixture always containing at least some traces of $H_2O_2$ in an effective amount.

It is advantageous, moreover, to operate the Z stage with an $O_2/O_3$ mixture containing a maximum of 10 mass % $O_3$ and a minimum $O_3$ level is effective. The temperature in the Z stage is maintained at 40° to 70° C., preferably 50° to 60° C.

The bleaching sequence EOP - Z - P commences upon the introduction of the off gas from the Z stage into a mixture of dissolving-grade pulp, NaOH and $H_2O_2$.

The parameters set forth above allow a 50% conversion of the charged oxygen with the pulp. It is possible to reduce the kappa value of the dissolving-grade pulp substantially. For example, the kappa value of the dissolving-grade pulp introduced into the Z stage should be a maximum of 3.0, preferably between 1.8 and 2.5 and preferably a maximum of 2.0. These kappa values allow maximum efficiency of the process and minimize the ozone treatment.

In earlier systems, paper pulps have required significantly more ozone. When the Z stage is operated as an LC stage, 0.5 to 10% $O_3$ in $O_2$ will suffice. The low $O_3$ level enables temperatures of 50° to 60° C. to be used so that the temperature need not be changed from the preceding stage and hence energy losses may be minimized. Off gases and waste water are recycled or reacted to minimize environmental hazards. The P stage, which follows the Z stage, can also be operated at a temperature corresponding to that of the preceding stage, for example, a temperature between 60° and 70° C., and thus requires less $H_2O_2$ than has been conventionally the case.

BRIEF DESCRIPTION OF THE DRAWING

The above and other objects, features and advantages of the present invention will become more readily apparent from the following description, reference being made to the accompanying drawing, the sole FIGURE of which is a flow diagram illustrating the invention.

SPECIFIC DESCRIPTION

In the drawing, we have shown a three-stage process in which the EOP stage is represented at 10, the Z stage at 20 and the P stage at 30.

The dissolving pulp is fed at **11*a* to the mixing unit 11 to which $H_2O_2$ and NaOH solutions are fed as represented at 11*b* and 11*c* to form the initial EOP mixture which is fed from the mixing stage 11 to an MC pump 12 which is followed by a high-shear MC mixer 13. High-shear mixers are described in the aforementioned copending application and indeed reference may be had to that application for any of the process parameters and equipment used for the various operations which may not be fully described herein. From the high-shear MC mixer 13, the EOP composition is fed to a prereaction tube 14 and thence to a bleaching tower 15. The bleaching tower 15 is followed by vacuum drum filters 16 and 17 and a worm press 18. The EOP bleaching pulp is delivered at 18*a* to the Z stage 20**.

In the Z stage, the EOP-bleached pulp is diluted at 21 with, for example, $H_2SO_4$ applied at **21*a* and with acidic filtrate from a line 52** as will be described below.

The diluted pulp is fed to the ozone bleaching unit 22 of the Z stage where it is treated with an $O_2/O_3$ mixture supplied at **22*a*. The off gas from the ozone-bleaching unit is separated at 22*b*, compressed by a pump 41 and supplied via line 43 through a fritted filter 42 and a line 44 to the pressure side of the MC pump 12. The system 40**, therefore, feeds off gas from the Z stage to the EOP stage.

The Z stage bleached pulp is fed at **22*a* to a washer 23 which is followed by a filtration unit 24 from which the Z stage bleached pulp at 25** is delivered to the P stage.

The filtrate from the Z stage, having a pH of less than 3 is fed by the system represented at 50 selectively to the diluter 21 via the line 51 and 52 and a pump 54 and/or via the lines 51, 53 and 56 to the final bleached pulp for de-ashing purposes. A pump 55 can feed the acidic filtrate for this purpose.

The P stage 30 comprises a bleaching unit 31 receiving the Z stage bleached pulp from line 25 and $H_2O_2$ and NaOH solutions as represented at **31*a*, 31*b* and effectuates a peroxide bleaching. The peroxide-bleached product is delivered at 34 to a vacuum filter 32 which is followed by a vacuum filter 33 on which the final pulp (line 36) is subjected to de-ashing with the acidic filtrate from line 56**.

EXAMPLE 1

Sorted beech wood dissolving-grade pulp, previously unbleached and with a kappa value of 5.2, a viscosity of 24.5 mPas and an Elrepho brightness of 55.6 is subjected to three-stage bleaching.

First Bleaching Stage (EOP)

The raw pulp with a consistency of 15% and a temperature of 75° C. is bleached with sodium hydroxide in an amount of 33 kg/t of dry bleached pulp (corresponding to 366 l of NaOH solution at 90 g/l) and 10.8 l of 50% aqueous $H_2O_2$ solution. The mixture is fed to an MC pump (middle consistency pump).

At the pressure side of the MC pump, 5.5 $m^3$ (STP) of off gas per t of dry bleached cellulose from the $O_3$ stage, compressed to 7 bar, is fed through a frit. With a proportion of about 95% $O_2$ in the gas, this corresponds to an $O_2$ feed of 7.5 kg of $O_2$ per t of pulp.

The suspension is then treated in a "High-Shear" MC mixer and into this mixture an additional 5.5 standard cubic meters per metric ton of dry bleached cellulose of off gas from the Z stage is supplied.

The resulting suspension is conducted through a prereactor tube with a residence time of 3 minutes and then conducted through an upwardly traversed bleaching tower with a reaction time of 2 hours 45 minutes.

The pulp is then dewatered on two vacuum drum filters and in a worm press. The filtrate from the worm press (3.3 $m^3$/t of pulp) is fed together with a further 3.3 $m^3$ of fresh water via washing pipes to the filters for washing in counterflow.

The organics entrained on the pulp can thus be reduced to 3 kg dry matter per t of pulp. The brightness amounted to 75.4%, the kappa value to 1.89 and the viscosity to 24.0 mPas.

Second Bleaching Stage (Z)

After leaving the worm press, the pulp is diluted to a consistency of 2% with recycled water from the vacuum drum filters of the Z stage (pH preferably less than 3) and is brought to a pH of 3 with sulfuric acid. In an ozone bleaching unit of conventional design (Waagner-Biro), the oxygen suspension of 2% consistency is circulated via an injector. 1.45 g of ozone per kg of pulp is introduced via the injector in a stepwise manner. The residence time in the reactor amounted to 20 minutes and the temperature to 51° C.

The pulp is again washed and the acid filtrate is used for the de-ashing of pulp before the final filter or is recycled for dilution in the manner described. The analytical values of the pulp were: brightness 78.3%, kappa value 0.97, viscosity 22.0 mPas.

Third Bleaching Stage (P)

The third stage is carried out with the supply of 4 kg NaOH/t of pulp and 7 kg $H_2O_2$ (50% aqueous) at 65° C. and 13% consistency with a residence time of 4 hours.

In further processing, the pulp is washed on two vacuum drum filters. Before the second of these filters, the pulp is acidified with the filtrate from the Z stage to reduce the ash content of the pulp to 0.06%.

Final pulp analysis:
Brightness 89.7%
Viscosity 21.8 mPas
Kappa value 0.76.

EXAMPLES 2 AND 3

In a continuous laboratory system for ozone bleaching in which ozone-containing oxygen is introduced via an injector into a pulp suspension, the results and parameters given below pertained.

The off gas was collected in a pressure vessel and was compressed by injection of water and introduced into a discontinuously operated EOP first bleaching step carried out in a stirred laboratory autoclave. The third or P stage was also carried out discontinuously.

| Raw-Material Data | Example 2 | Example 3 |
|---|---|---|
| Beech Wood Dissolving Pulp | | |
| Brightness | 52.8% | 58.3% |
| Viscosity | 26.4 mPas | 23.9 mPas |
| Kappa value | 8.05 | 5.85 |
| Alpha-cellulose content | 89.4% | 89.6% |
| 1st Bleaching Stage | | |
| Temperature | 85° C. | 73° C. |
| NaOH-Charge | 40 kg/t dry bleached pulp | 30 kg/t pulp |
| $O_2$Charge | 18 kg/t | 12 kg/t |
| $H_2O_2$-Charge | 6.3 kg/t | 5.0 kg/t |
| Residence time | 3 h | 3 h |
| Consistency | 14% | 14% |
| Pulp Data After 1st Bleaching Stage | | |

-continued

| Raw-Material Data | Example 2 | Example 3 |
|---|---|---|
| Kappa value | 2.2 | 2.4 |
| Brightness | 74.2% | 75.1% |
| Viscosity (TAPPI) | 25.2 mPas | 22.8 mPas |
| 2nd Bleaching Stage | | |
| Temperature | 50° C. | 50° C. |
| pH | 2.8 | 2.8 |
| $O_3$-Charge | 1.85 kg/t | 1.3 kg/t |
| Consistency | 2% | 2% |
| Pulp Data After 2nd Bleaching Stage | | |
| Kappa value | 0.85 | 1.1 |
| Viscosity | 22.8 mPas | 21.4 mPas |
| 3rd Bleaching Stage | | |
| Temperature | 64° C. | 66° C. |
| Residence time | 4 h | 4 h |
| Consistency | 13% | 13% |
| NaOH-Charge | 0.35% | 0.6% |
| $H_2O_2$-Charge | 0.35% | 0.6% |
| Final Pulp Data | | |
| Kappa value | 0.70 | 0.70 |
| Brightness | 90.1% | 89.8% |
| Viscosity | 22.2 mPas | 20.9 mPas |
| Alpha-Cellulose content | 90.8% | 90.6% |

EXAMPLE 4

Pulp after the first bleaching stage of Example 1 is removed and subjected to laboratory processing. The pulp had the following characteristics:

Brightness 75.4%, kappa value 1.89, viscosity 24.0 mPas.

The pulp was pressed to a consistency of 20% and diluted to a consistency of 11% with dilute sulfuric acid so that the pH of the suspension was 2.9.

In a "High-Shear" mixer, this pulp suspension is fluidized and compressed $O_3$-containing oxygen is introduced. The mixing time amounted to 15 seconds, the reaction time to 180 seconds, the $O_3$ pressure to 5.1 bar and the temperature to 50° C.

The specific $O_3$ charge was 1.50 g $O_3$/kg of dry bleached pulp and $O_3$ consumption was 1.4 g.

Analysis of Resulting Pulp

Brightness: 80.4%
Viscosity: 21.4 mPas
Kappa value: 0.92

This pulp is subjected to a laboratory P-stage bleaching:

Temperature: 64° C.
Residence time: 4 h
Consistency: 13%
NaOH-Charge: 0.38%
$H_2O_2$-Charge: 0.38%
Final Pulp Data
Kappa value: 0.72
Brightness: 90.0%
Viscosity: 20.8 mpas

We claim:

1. A chlorine-free method of bleaching dissolving-grade pulp, comprising the steps of:

(a) in an OP-stage, subjecting dissolving-grade pulp to alkaline oxygen bleaching in the presence of hydrogen peroxide, and filtering the alkaline oxygen-peroxide bleached pulp from a filtrate, said alkaline oxygen-peroxide bleached pulp having a kappa value of a maximum of 3.0;

(b) in a Z-stage, subjecting said alkaline oxygen-peroxide bleached pulp from step (a) to a single ozone bleaching and recovering a Z-stage bleached pulp, an off gas containing residual oxygen and a waste water having a pH of less than 3;

(c) subjecting said Z-stage bleached pulp to peroxide bleaching in a P-stage and recovering a final bleached pulp therefrom;

(d) feeding said off gas from said Z-stage of step (b) directly to said bleaching stage of step (a) and fully reacting said residual oxygen therein; and (e) selectively feeding said waste water recovered from said Z stage in step (b) as a diluent to said alkaline oxygen-peroxide bleached pulp prior to step (b) and to peroxide-bleached pulp following P-stage bleaching in step (c) for de-ashing of said peroxide-bleached pulp.

2. The method defined in claim 1 wherein the temperature, an NaOH charge and an $O_2/H_2O_2$ ratio in said alkaline oxygen-peroxide bleaching stage of step (a) are so controlled that the oxygen consumption, for a constant throughput, corresponds to the residual oxygen content of the off gas from the Z stage of step (b).

3. The method defined in claim 2 wherein said temperature is maintained at 70° C. to 100° C.

4. The method defined in claim 3 wherein said temperature is maintained at about 75° C.

5. The method defined in claim 3 wherein an NaOH concentration in said alkaline oxygen-peroxide bleaching stage of step (a) is maintained between 2.5 and 5 mass-percent based upon dry bleached pulp.

6. The method defined in claim 3 wherein an $O_2/H_2O_2$ mixture is provided in said alkaline oxygen-peroxide bleaching stage of step (a), further comprising maintaining a concentration of $O_2$ in said $O_2/H_2O_2$ mixture at substantially 50 to 100 mass percent and a concentration of $H_2O_2$ in said $O_2/H_2O_2$ mixture at substantially 0 to 50 mass percent.

7. The method defined in claim 1 wherein bleaching is carried out in said Z stage of step (b) with an $O_2/O_3$ mixture with a maximum of 10 mass percent $O_3$.

8. The method defined in claim 1 wherein a bleaching temperature is maintained in said Z stage of step (b) of 40° to 70° C.

9. The method defined in claim 8 wherein said bleaching temperature in said Z stage of step (b) is maintained at 50° to 60° C.

* * * * *